US006241362B1

(12) United States Patent
Morrison

(10) Patent No.: US 6,241,362 B1
(45) Date of Patent: Jun. 5, 2001

(54) LIGHTED DISPLAY EMITTING VARIABLE COLORS

(76) Inventor: David J. Morrison, 8432 Running Deer Ave., Las Vegas, NV (US) 89128

( * ) Notice: Subject to any disclaimer, the term of this patent is extended or adjusted under 35 U.S.C. 154(b) by 0 days.

(21) Appl. No.: 09/356,879

(22) Filed: Jul. 19, 1999

(51) Int. Cl.[7] ..... F21V 9/08

(52) U.S. Cl. ..... 362/231; 362/101; 362/392; 362/806

(58) Field of Search ..... 362/101, 230, 362/231, 234, 236, 244, 246, 249, 251, 392, 441, 447, 455, 800, 806, 808, 810, 811, 381, 96

(56) References Cited

U.S. PATENT DOCUMENTS

| | | | |
|---|---|---|---|
| 2,353,063 | 7/1944 | Otis . | |
| 2,435,811 | 2/1948 | Waters . | |
| 2,465,700 | 3/1949 | Tuttle . | |
| 2,590,279 | 3/1952 | Soss . | |
| 2,714,652 | 8/1955 | Meyer . | |
| 3,761,702 | 9/1973 | Andeweg . | |
| 3,762,857 | 10/1973 | Andeweg . | |
| 3,816,739 | 6/1974 | Stolov . | |
| 3,890,085 | 6/1975 | Andeweg . | |
| 4,264,845 | 4/1981 | Bednarz . | |
| 4,630,177 | 12/1986 | Von Kohorn et al. . | |
| 4,945,460 | 7/1990 | Von Kohorn . | |
| 5,319,531 | 6/1994 | Kutnyak . | |
| 5,575,098 | 11/1996 | Goettel-Schwartz . | |
| 5,619,182 | 4/1997 | Robb . | |
| 5,624,177 | 4/1997 | Rosaia . | |
| 5,690,412 | 11/1997 | Sheldon . | |
| 5,967,639 * | 10/1999 | Shih | 362/806 |

* cited by examiner

*Primary Examiner*—Y. Quach
(74) *Attorney, Agent, or Firm*—Richard C. Litman

(57) ABSTRACT

A lighted display device includes three light emitting diodes therein, with each of the diodes transmitting a different one of the three subtractive primary colors of red, yellow, and blue when electrical power is applied thereto. The three LEDs are capable of collectively emitting any of the colors of the visual spectrum, depending upon the relative electrical power which is applied separately and collectively to them. The LEDs are contained in the center of a base, and are installed upon a circuit board which is in turn installed within the base. A light passage is provided in the center of the upper surface of the base, with various articles being installable thereon for supporting translucent statuary, candles, etc. as desired for lighted display thereof. The present lighted device includes circuitry for automatically varying the relative intensity of each of the LEDs over a predetermined period of time, resulting in the LEDs collectively emitting a broad spectrum of gradually changing colors over the time period. The circuitry may be adjusted to provide for the transmission of a single color by any one or two of the LEDs if so desired, as well. The present lighted display device provides for the display of various translucent art objects and the like, with the varying colors emitted therethrough providing a wide variety of interest as the color and appearance of the displayed object varies.

14 Claims, 6 Drawing Sheets

64

LIGHTED DISPLAY EMITTING VARIABLE COLORS

BACKGROUND OF THE INVENTION

1. Field of the Invention

The present invention relates generally to electrically illuminated displays, and more specifically to an electrically lighted display device using three light emitting diodes (LEDs) each having a different subtractive primary color, i.e., red, yellow, and blue. Electrical power to each of the LEDs is varied to vary the intensity in a predetermined manner, thereby changing the color emitted by the LED group. The lighting means may be used to project light of virtually any color desired, through a transparent or translucent display article.

2. Description of the Related Art

Tabletop artwork and displays are popular decorative articles in most home and office environments. While quality artwork is always appreciated, the staff or residents of an office or home where such artwork is displayed, become used to the display after some period of time, and may no longer appreciate the work. While interest may be retained by periodically changing such artwork and displays in order to provide variety, this is not economically feasible for most households or offices. While such artwork may be moved to various locations for the sake of variety, such relocation requires additional labor which is not desirable.

Accordingly, some means of easily and inexpensively altering the appearance of existing tabletop statuary, sculpture, and other artwork, would provide a refreshing change for persons who live and work daily with such artwork. The present invention responds to this need by providing lighting means for translucent and transparent articles, with the lighting comprising a series of three light emitting diodes (LEDs), each of a different one of the three subtractive or pigment primary colors (i.e., red, yellow, and blue). By varying the electrical power to each of the LEDs collectively and separately in a predetermined manner, the color output and intensity of the LEDs may be varied as desired to produce virtually any color desired. The cycle may be automated to vary the color over a predetermined period of time, or may be adjusted to project a specific color as desired. The present lighted display may be used to provide color for virtually any transparent or translucent object placed thereon, e.g., statuary, candles, transparent and translucent holders for such articles, etc., as desired. Different bases may be provided, with the bases comprising a solid fixture for the placement of display articles thereon, or having a basin or receptacle for holding a liquid therein, if so desired.

A discussion of the related art of which the present inventor is aware, and its differences and distinctions from the present invention, is provided below.

U. S. Pat. No. 2,353,063 issued on Jul. 4, 1944 to Carl W. Otis, titled "Ornamental Illuminating Device," describes a "bubble-light" type of ornamental light, as used in Christmas tree lighting and the like. While Otis notes that the liquid within the tube may be colored to provide different effects, he does not provide for coloring the light output by changing the color of the light itself, as provided in the present invention. The light (and heat) source in the Otis light is a clear, uncolored incandescent bulb, which transmits its light (and heat) to the liquid filled tube thereabove. The liquid used by Otis may be colored, but the colors cannot be changed, as provided by the multiple colored LED light sources of the present invention. Moreover, Otis cannot provide for different display articles to be placed upon his lighting device, whereas the present lighted display provides for such.

U. S. Pat. No. 2,435,811 issued on Feb. 10, 1948 to Harry F. Waters, titled "Artificial Candle," describes an electrical light bulb base for installation in a standard light socket, with the base in turn having a smaller diameter elongate incandescent bulb therein. The bulb is surrounded by a partially transparent or translucent cylindrical shell, simulating a candle. A simulated flame is provided, with a heat driven deflector disposed at the top of the bulb to simulate the flickering of the flame as it turns due to heat rising from the bulb. Waters does not provide any means of supporting a display article atop his simulated candle, nor for changing the color of the display, as provided by the present illuminated display invention.

U. S. Pat. No. 2,465,700 issued on Mar. 29, 1949 to Louis P. Tuttle, titled "Ornamental Lighting Fixture," describes a small lighting device including a clip for removable attachment to a Christmas tree branch or the like. Various translucent display articles may be attached to the relatively small base, which in turn closely surrounds a single small incandescent bulb. The Tuttle lighting fixture cannot be placed upon a table, as provided by the present lighted display. Moreover, Tuttle does not provide any means for changing the perceived color of the article being displayed thereon, by changing the color of the light. In contrast, the present display device alters the color of the light transmitted by the three differently colored LED devices disposed in the base of the device.

U. S. Pat. No. 2,590,279 issued on Mar. 25, 1952 to Mark Soss, titled "Bubbling Liquid Toy," describes a device similar to the "bubble light" device of Otis, described further above. Soss provides a solid figure within the liquid filled tube above the single incandescent bulb, with the figure being carried to the top of the tube as the liquid is brought to a boil by the heat of the bulb. As in the Otis device, the only means provided by Soss for altering the emitted color of his device is by changing the color of the liquid within the tube and lower bulb. Soss, and other patentees noted to this point, provide only one clear incandescent bulb to provide the light (and/or heat) required for their devices, and cannot provide any means for changing the color output by changing the color of the light emitted by the lighting means.

U. S. Pat. No. 2,714,652 issued on Aug. 2, 1955 to Harry G. P. Meyer, titled "Illuminated Garden Ornament Assemblies," describes a relatively tall and narrow lighted ornament adapted to be secured to the ground by means of a spike extending therefrom, rather than being placed upon a table or other level surface, as in the case of the present invention. Translucent display articles are provided, having specially formed bases for fitting closely over the single incandescent bulb of the device. As in the other devices discussed to this point, Meyer makes no provision for altering the color of the light emitted by the device, other than altering the color of the translucent article being displayed.

U. S. Pat. No. 3,761,702 issued on Sep. 25, 1973 to Frits J. Andeweg, titled "Internally Illuminated Candle," describes several embodiments of an otherwise conventional candle having a hollowed center, with one or more incandescent bulbs being placed therein for lighting the candle from within. Andeweg notes in at least one embodiment that multiple incandescent bulbs may be placed within the candle, with each bulb being a different color if so desired. However, Andeweg fails to provide any means of adjusting the combined color output of the lighting means while the device is in use. The present illuminated display provides such means of varying the color output, by adjusting the electrical power to each of the LEDs therein either separately or collectively, as desired. Moreover, the present display device provides for the placement of a translucent display article thereon, whereas the Andeweg hollow candle precludes placement of other articles thereon.

U. S. Pat. No. 3,762,857 issued on Oct. 2, 1973 to Frits J. Andeweg, titled "Candle Internal Illuminator And Mount Base," describes various additional embodiments over those of his '702 U.S. Patent, discussed above. In some of the embodiments, Andeweg provides means for varying the color emitted by the device, either manually or automatically. Andeweg provides a disc having various colored lenses therein, which is rotatably installed above the single incandescent light source. The disc may be rotated manually or by means of an electric motor to position any one of the lenses over the incandescent light source, as desired. However, the colored lighting so produced is relatively limited in comparison to the present invention, with its three light emitting diodes each of a different subtractive primary color. The present invention provides means for adjusting the power to each of the LEDs, either collectively or individually, thus providing for virtually any collective color output desired, rather than being limited to a relatively few colors according to a relatively small number of colored lenses and a single clear incandescent light source. Moreover, Andeweg's single light source with its unvarying intensity and motor drive for automatic operation, result in a fixed, unvarying repetitive order of colors, whereas the present invention provides means for varying the collective colors emitted by the LEDs in virtually any pattern and hue imaginable, as desired.

U. S. Pat. No. 3,816,739 issued on Jun. 11, 1974 to Michael Stolov, titled "Illuminating Device," describes a device having at least one light source of each of the additive primary colors (i.e., red, blue, and green). Each light source (or group of lights having the same color) is controlled by a separate rheostat to vary the power thereto, and thus the light output therefrom. Each rheostat must be adjusted individually, with the adjustment required to achieve a given color being relatively tedious due to the need to adjust all three rheostats. In contrast, the programming of the present lighting system provides for the automatic variation of the total color output as desired, with the color being varied throughout essentially all of the colors of the rainbow throughout a single cycle. Alternatively, the present lighted display device may be set to provide a single color, as desired. It should also be noted that Stolov utilizes the additive primary colors, rather than the subtractive primary colors of red, yellow, and blue (sometimes referred to as magenta, yellow, and cyan), as provided by the present lighted display device. The use of subtractive primary colors in the present invention permits any color to be displayed, with interference between colors resulting in a darker, rather than a brighter, apparent output. Stolov also uses "light bulbs" (column 2, line 53 through column 3, line 7), and relies upon coating the bulbs with the desired colors. In contrast, the LEDs utilized in the present invention inherently provide the desired color output without additional painting, coloring, or lenses.

U. S. Pat. No. 3,890,085 issued on Jun. 17, 1975 to Frits J. Andeweg, titled "Illuminated Candle Structure," is a continuation in part of the '702 U.S. Patent to the same inventor described further above. At least one embodiment includes multiple light sources which may be of different colors, as disclosed in the above described '702 U.S. Pat. Again, however, Andeweg fails to disclose any means of varying the color or intensity of the light output in his illuminated devices, whereas the present illuminated display article includes such means.

U. S. Pat. No. 4,264,845 issued on Apr. 28, 1981 to Robert W. Bednarz, titled "Ornamental Light Display And Circuit Therefor," describes circuitry which responds to binary signals from another source (e.g., music, voice, etc.) and which controls a plurality of LED light sources accordingly. Bednarz does not describe the use of LEDs having different color outputs, nor does he describe a control system for controlling the intensity of such differently colored LEDs to produce various color outputs, as provided by the present illuminated display device.

U. S. Pat. No. 4,630,177 issued on Dec. 16, 1986 to Henry Von Kohorn et al., titled "Light-Conductive Device For Illuminating Centripetally Viewed Three-Dimensional Objects," describes various configurations of translucent devices adapted for projecting light onto an article displayed therewith. The light source is a single incandescent bulb, with no color (either variable or constant) being disclosed, and hence no means for varying the color, as provided by the present invention.

U. S. Pat. No. 4,945,460 issued on July 31, 1990 to Henry Von Kohorn, titled "Glare-Free Illuminating Apparatus," describes a light box having two parallel panels with a series of light passages therethrough. The object to be lighted is placed atop the uppermost panel. As in the '177 U.S. Patent to the same inventor discussed immediately above, the '460 U.S. Patent does not disclose the use of more than a single light source, and does not disclose any means of providing color, or varying the color, emitted by the light source, in contrast to the present invention with its LEDs comprising the three subtractive primary colors and means for varying the power and combined color output of the LEDs.

U.S. Pat. No. 5,319,531 issued on Jun. 7, 1994 to Mark R. Kutnyak, titled "Illuminated Flying Disc With Special Effects Lighting," describes the installation of a plurality of LEDs in a "Frisbee" (tm) type flying toy. Kutnyak provides for only two different colors of LEDs, and thus cannot provide for all possible color combinations of the visible spectrum. Moreover, Kutnyak operates the LEDs using a square wave oscillator to generate on-off signals to the LEDs, rather than varying their mutual intensity over some period of time to generate complementary colors, as provided by the present lighted display device. Kutnyak suggests the use of only red and green LEDs, and with his control circuitry, the result is that only these two colors may be observed from the device equipped with his lighting system. Also, the Kutnyak device cannot provide for the stationary illumination of another display device, as provided by the present invention.

U.S. Pat. No. 5,575,098 issued on Nov. 19, 1996 to Jeannette C. Goettel-Schwartz, titled "Illuminated Display Apparatus," describes a display having a plurality of small light sources (LEDs, etc.) therein which are illuminated collectively or selectively by an operating program. However, Goettel-Schwartz does not provide for different colored LEDs, nor any means of varying the power to such differently colored LEDs to vary their collective perceived color output, as provided by the present lighted display. Moreover, the device itself is the display of the Goettel-Schwartz apparatus, rather than the device being used to project light onto another article for display thereof, as in the present invention.

U.S. Pat. No. 5,619,182 issued on Apr. 8, 1997 to Charles L. R. Robb, titled "Configurable Color Selection Circuit For Choosing Colors Of Multi-Colored LEDs In Toys And Secondary Automotive Flasher/Brake Indicators," describes the use of tri-colored LEDs for providing auxiliary brake and turn signal indications, variably colored eyes in toys, etc. Robb provides a switch panel which turns power on and off to the leads or contacts of the LEDs, with each of the LEDs producing either red, green, or amber (yellow), depending upon the power applied to each lead. Robb makes no provision for varying the power to the LEDs, but only for applying either full power or no power to each lead. Thus, the LEDs are capable of producing only three colors, which include some colors from both additive and subtractive primaries. Such colors cannot be used to produce all colors of the spectrum, as provided by the circuitry of the present lighted display device.

U.S. Pat. No. 5,624,177 issued on Apr. 29, 1997 to Kirk S. Rosaia, titled "I.C.B. Illuminating Unity Ring For Drinking Glass," describes an add-on device attachable to the base of a drinking glass, for illuminating the contents of the glass. The device includes a single, untinted LED (column 4, lines 54 –55) with on/off circuitry; no means for altering the color or intensity of the LED is provided by Rosaia. While the Abstract states that colored light may be provided, no means is described for doing so by Rosaia in his disclosure.

Finally, U.S. Pat. No. 5,690,412 issued on Nov. 25, 1997 to Joseph M. Sheldon, titled "Solar Illuminated Jewelry," describes a simple circuit with solar cells and battery in parallel with lighting means (LED, etc.). A double throw switch is used to close either the charging side of the circuit or the lighting side of the circuit, as desired. Sheldon provides only a single LED, and does not provide any means of altering the color or intensity thereof in his circuit. It should also be noted that the Sheldon device is not suitable for illuminating a tabletop display article of some sort, as the gemstone or other article being displayed by the Sheldon device, is permanently mounted therein and cannot be removed or exchanged for the display of another work of art, as provided by the present lighted display invention.

None of the above inventions and patents, taken either singly or in combination, is seen to describe the instant invention as claimed.

SUMMARY OF THE INVENTION

The present invention comprises a lighted display device for illuminating various transparent or translucent pieces of art which may be interchangeably placed thereon. The present device utilizes a series of three light emitting diodes LEDs), each emitting one of the three subtractive primary colors (i.e., red, yellow, and blue). These three colors may be combined to emit any perceived color of the visual spectrum, by varying the electrical power to the respective LEDs and thus the intensity of the color emitted by each LED. A circuit is provided which allows a user of the device to adjust the power as desired to provide a given color output, or which may be left in an automated mode to adjust the power to the LEDs to vary their color output automatically over a predetermined period of time.

The circuitry of the present invention is installed within a tabletop base or the like, which provides for the temporary and removable placement of any of a series of various translucent articles thereon (e.g., candles, statuary, etc.). The base may comprise any of a number of different embodiments, including translucent, flat adapter plates for statuary, candle holders for candles, a toroidal receptacle disposed about the central LED light emission passage for containing water, or other configuration as desired. Preferably, the base itself is opaque to block the passage of light therethrough, with the exception of a single central passage disposed above the three LEDs so that their emitted light is projected upwardly through a display article thereabove.

Accordingly, it is a principal object of the invention to provide an improved lighted display device for illuminating a translucent article placed thereon with one or more colors of the visual spectrum as desired.

It is another object of the invention to provide an improved lighted display device which lighting means comprises a series of three light emitting diodes, with each of the diodes producing light in a different one of the three subtractive primary colors.

It is a further object of the invention to provide an improved lighted display device including electronic circuitry therefor, for controlling the light output of the three LEDs as desired.

An additional object of the invention is to provide an improved lighted display device which circuitry may be adjusted to cause the LEDs to produce a single color as desired, or to change color gradually over a predetermined period of time as desired.

Still another object of the invention is to provide an improved lighted display device including a base for setting upon a tabletop or the like, with the base including the LEDs and circuitry of the present invention and means for supporting a translucent article placed thereon for lighted display thereof.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
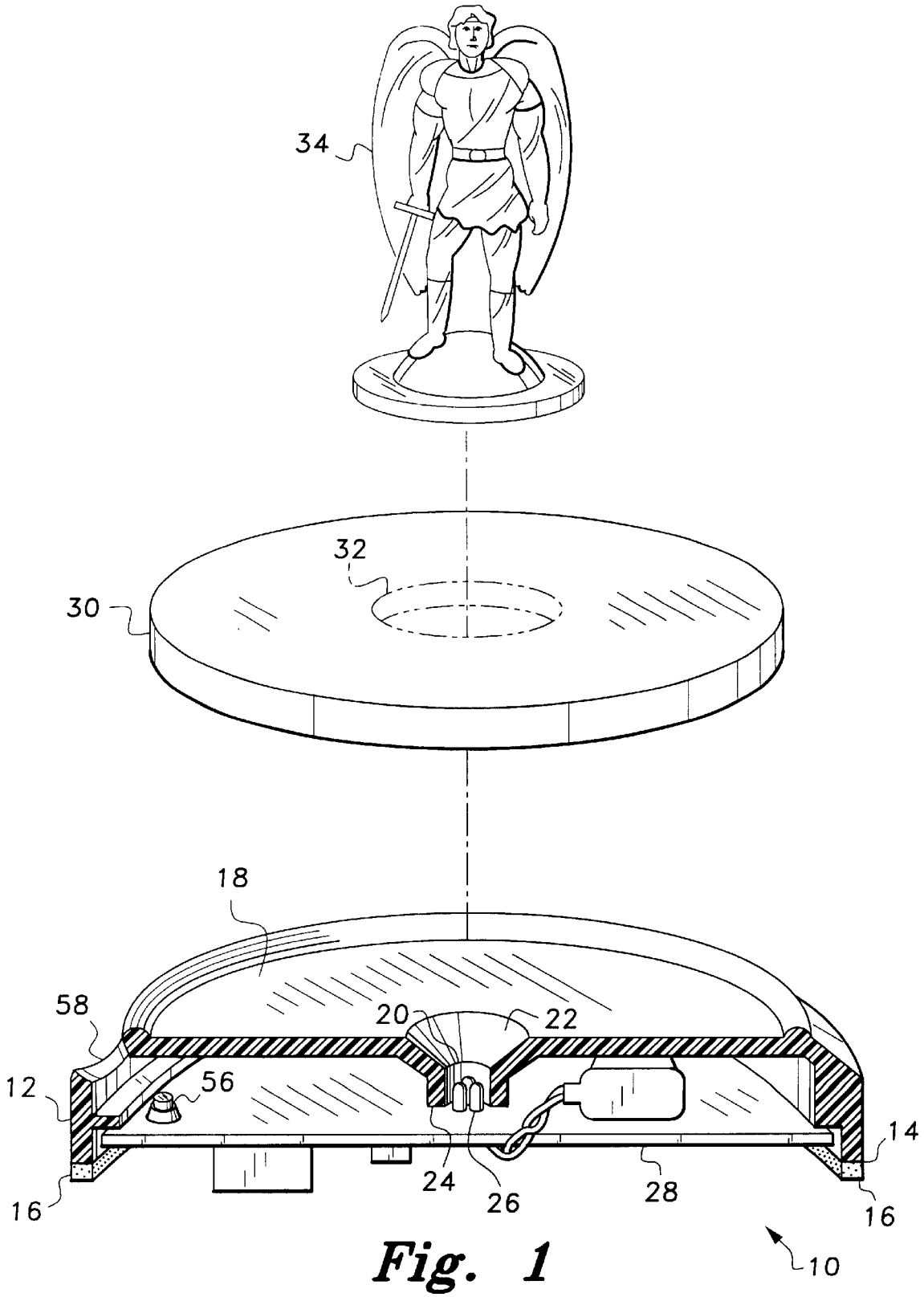
FIG. 1 is an exploded perspective view of a first embodiment of the present lighted display device, with the base portion shown in section to show various details thereof.

The present invention comprises a lighted display device, for emitting various hues of the visible spectrum and tinting or coloring a translucent article placed thereon, accordingly. FIG. 1 illustrates an exploded view of a first embodiment of the present display device 10, with the base 12 being shown in section to illustrate various details and components thereof. The base 12 may be circular or other shape as desired and is preferably formed of opaque material (plastic, ceramic, etc.) and has a generally flat bottom, 14, or at least a rim comprising a bottom edge, for removable or portable placement on any suitable level surface as desired (e.g., tabletop, etc.). Footpads 16 may be installed beneath the bottom 14 as desired. The base 12 further includes an upper surface 18 with a light passage 20 formed therethrough, with the light passage 20 having an upper end 22 and opposite lower end 24. The light passage 20 may be formed concentrically through the upper surface 18 of the base 12, or offset as desired.

A series of three light emitting diodes (LEDs) 26 is disposed beneath the upper surface 18 of the base 12, and extends upwardly from a circuit board 28 or other suitable mounting means. The LEDs 26 are positioned within the lower end 24 of the light passage 20, so that their light is projected upwardly through the passage 20 when they are illuminated. The LEDs 26 are indicated as a group in FIGS. 1 through 3, as they are preferably disposed immediately adjacent one another, so that their emitted light blends when diffused through a translucent article placed atop the base 12.

Figure 4:
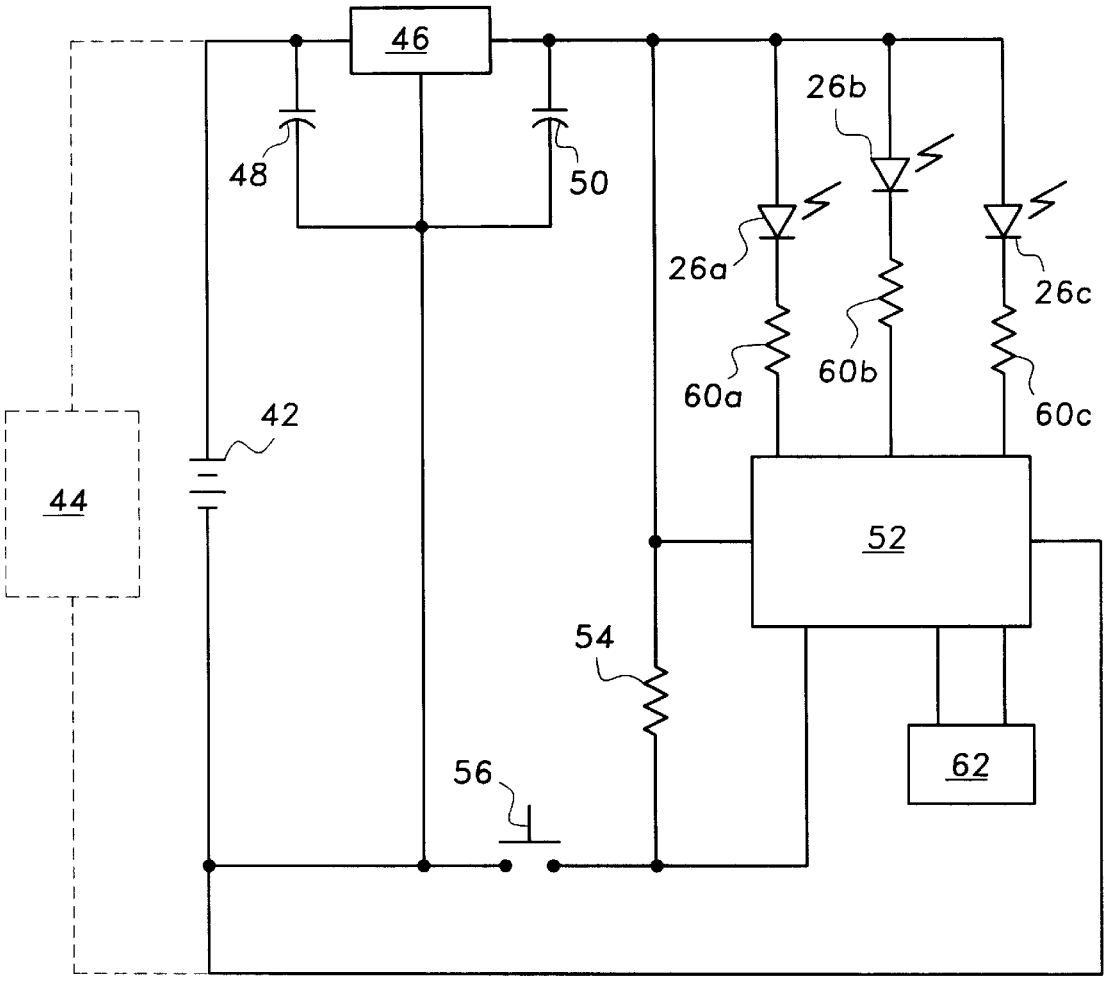
FIG. 4 is an electrical schematic of the circuitry used in the present lighted display device.

The LEDs 26 are shown schematically in the electrical circuit of FIG. 4, and are separately designated as LEDs 26*a*, 26*b*, and 26*c*. Preferably, each of the LEDs 26*a* through 26*c* emits a different one of the three primary colors of the visual spectrum, i.e., those colors from which any of the other colors of the spectrum may be produced by blending the primary colors in appropriate intensities or amounts. Each LED 26*a* through 26*c* of the present display device 10 preferably produces a different one of the subtractive primary colors red, yellow, and blue (sometimes called magenta, yellow, and cyan) when appropriate electrical power is applied thereto. The specific circuitry illustrated schematically in FIG. 4 is discussed in detail further below.

The base 12 of the device 10 of FIG. 1 has a flat upper surface, adapted for the placement of any one of a number of different display articles thereon. A translucent article support 30 may be removably placed atop the upper surface 18 of the base 12, in order to further diffuse and distribute the light emitted by the LEDs 26. The article support 30 may comprise a flat sheet of material having the same general configuration as that of the upper surface 18 of the base 12 in order to fit properly therewith, as shown in FIG. 1. A light passage 32 (shown in broken lines in FIG. 1) may be provided, with the light passage 32 preferably being concentric with the light passage 20 of the base 12 when the article support 30 is placed thereon. The light passage 32 of the article holder 30 serves to distribute the light upwardly into the translucent article being displayed.

The flat article holder 30 of FIG. 1 serves to support a translucent display article 34 thereon, such as the exemplary statue illustrated in FIG. 1. It will be understood that the statue display article 34 of FIG. 1 is exemplary, and that a practically innumerable number of different types of display articles may be placed upon the present lighted display device 10 for lighted display thereon, as desired.

Figure 2:
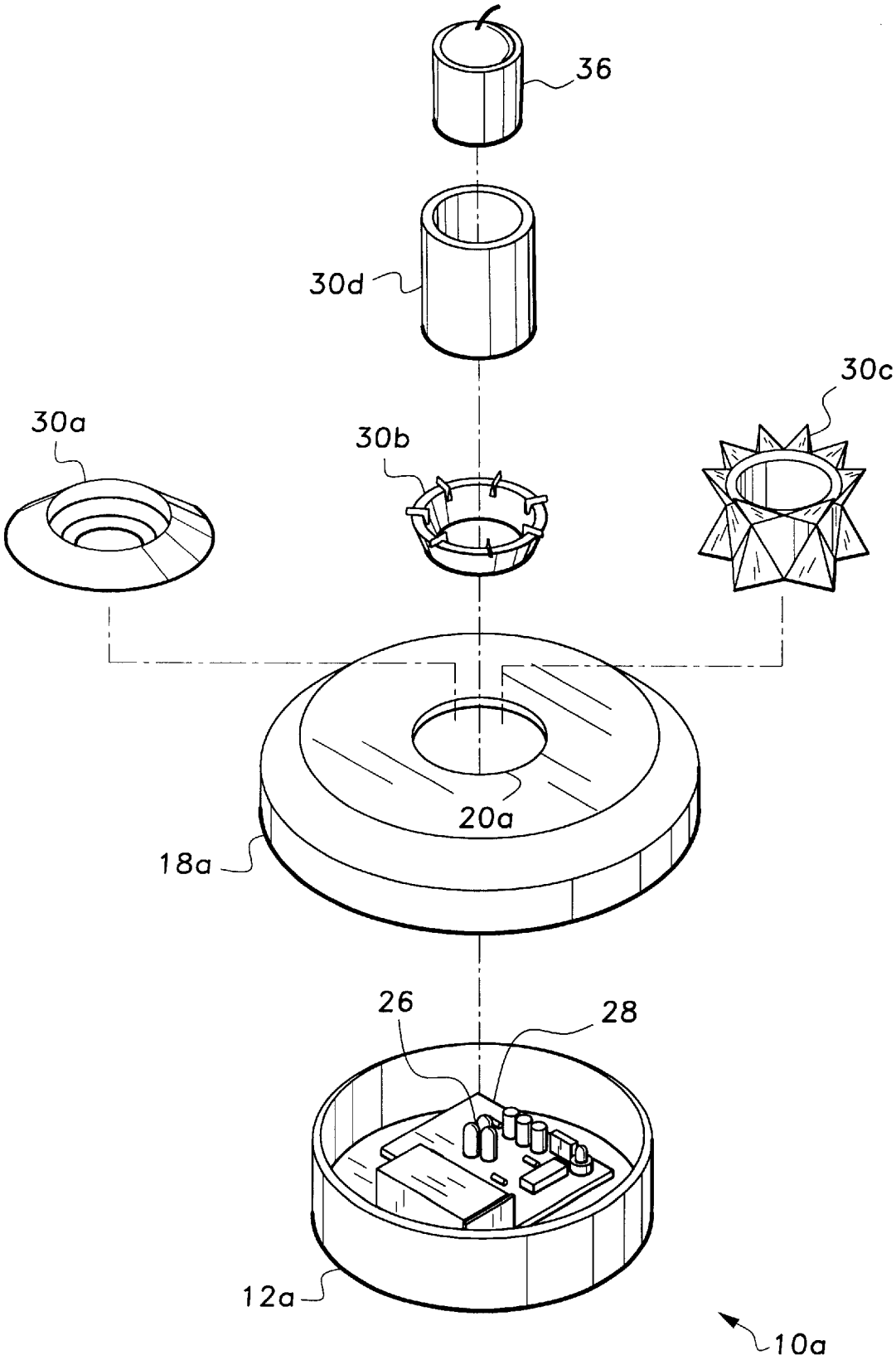
FIG. 2 is an exploded perspective of a second embodiment of the present display device, showing various means of displaying a candle thereon.

The present display device is not limited only to the display of statuary, as indicated in the illustration of FIG. 2 of the drawings. In FIG. 2, a display device 10*a* has a base 12*a* containing the three LEDs 26 and electrical circuitry on a circuit board 28. A removable upper cover 18*a* is placed over the base portion 12*a* for enclosing the interior of the base 12*a* and circuitry contained therein. A light passage 20*a* is provided through the upper cover 18*a*, somewhat in the manner of the light passage 20 of the upper portion 18 of the device 10 of FIG. 1.

In FIG. 2, a series of article holders or supports 30*a* through 30*d* is illustrated, for the holding or support of a candle 36 therein. The candle holder supports 30*a* through 30*d* are adapted to fit upon or within the light passage 20*a* of the upper cover 18*a*, for supporting a votive or other type of candle 36 therein. The candle holder supports 30*a* through 30*d* are preferably transparent or translucent, in order to diffuse and/or refract the light emitted by the LEDs 26. Such candle holders may comprise a faceted holder 30*c*, for refracting the light, a simple transparent or translucent sleeve 30*d*, or other configuration as desired.

Figure 3:
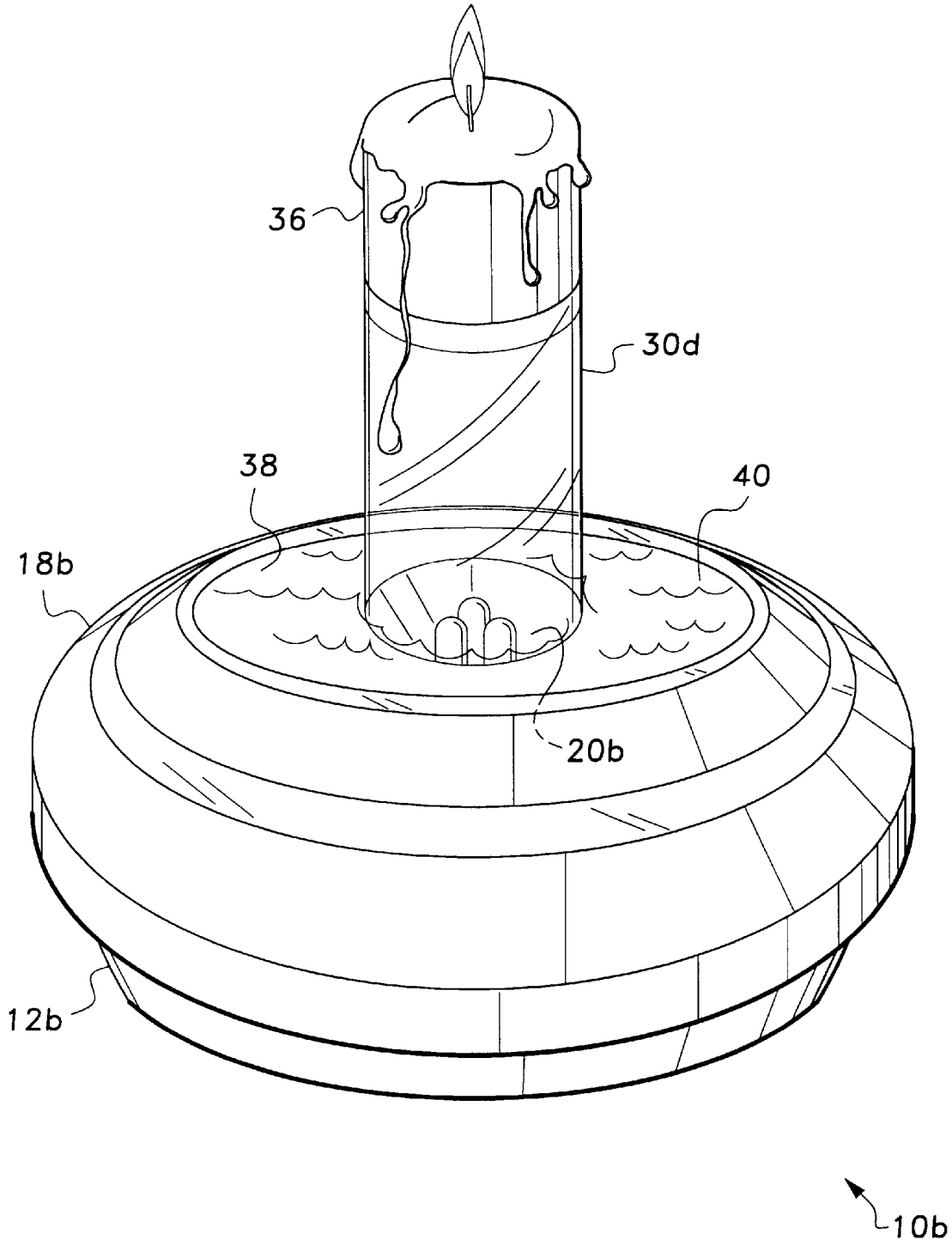
FIG. 3 is a perspective view of another embodiment of the present device, showing a base having a toroidal receptacle for holding water therein.

FIG. 3 illustrates another variation or embodiment upon the present invention, comprising lighted display device 10*b*. In FIG. 3, the upper portion 18*b* of the base 12*b* includes a generally toroidally shaped receptacle 38 surrounding the centrally disposed light passage 20*b*. The receptacle 38 may be filled with a liquid 40 of some sort (e.g., clear or tinted water) in order to reflect and highlight the colors emitted by the lighted display installed above the light passage 20*b*. In FIG. 3, a clear sleeve type candle holder 30*d*, as illustrated in the exploded perspective view of FIG. 2, is placed over the light passage 20*b*, with a lighted votive candle 36 or the like being installed in the upper portion of the sleeve candle holder 30*d*. The water or other liquid 40, in combination with the light emanating from the clear candle holder sleeve 30*d* and the translucence of the lighted candle 36, provide a most attractive display.

FIG. 4 discloses the basic electrical circuitry required for the operation of the present lighted display device in its various embodiments. The present circuitry may be powered by an electrical battery 42 (e.g., nine volt DC rectangular "radio battery," etc.) or by a suitable power supply 44 (e.g., 115 volt AC "household current"), indicated as an alternative by the block in broken lines in FIG. 4. Electrical power is provided to an appropriate power supply 46, for converting the electrical energy to the proper voltage and frequency as required. A National Semiconductor 78L05 has been found to be suitable; other suitable types and configurations may be used as desired.

First and second capacitors 48 and 50 are placed in parallel respectively with the input and output sides of the power supply 46, with the first capacitor 48 reducing spurious high frequency signals or "noise" and the second capacitor 50 smoothing the output signal from the power supply 46. Power from the power supply 46 is provided to a suitable micro control unit 52; a Phillips 51LPC has been found to be suitable for controlling the present electrical circuit. Other equivalent devices may be substituted therefor, as desired. Power is provided directly to one input, and through a resistor 54 to a second input. The second input is selectively grounded through a normally open switch 56, which may be installed on the circuit board 18 and accessed through an appropriate passage 58 in the base 12 of the device 10, as shown in FIG. 1 of the drawings. The control unit 52 changes its operating condition each time the circuit is momentarily grounded by switch 56, to select the specific program to operate the three LEDs 26*a* through 26*c*.

The three LEDs 26*a* through 26*c*receive power directly from the power supply 46, and are grounded through the micro control unit 52 and suitable resistors, respectively 60*a* through 60*c*, in series with each of the LEDs 26*a* through 26*c*. The micro control unit 52 selectively controls the current flow across each of the LEDs 26*a* through 26*c*, either collectively or separately as desired, by controlling their ground state within the micro control unit 52 according to its programming, as described further below. A 20 mHz crystal timer oscillator 62 (or other suitable equivalent) is provided for controlling the operational time intervals of the LEDs.

Figure 5:
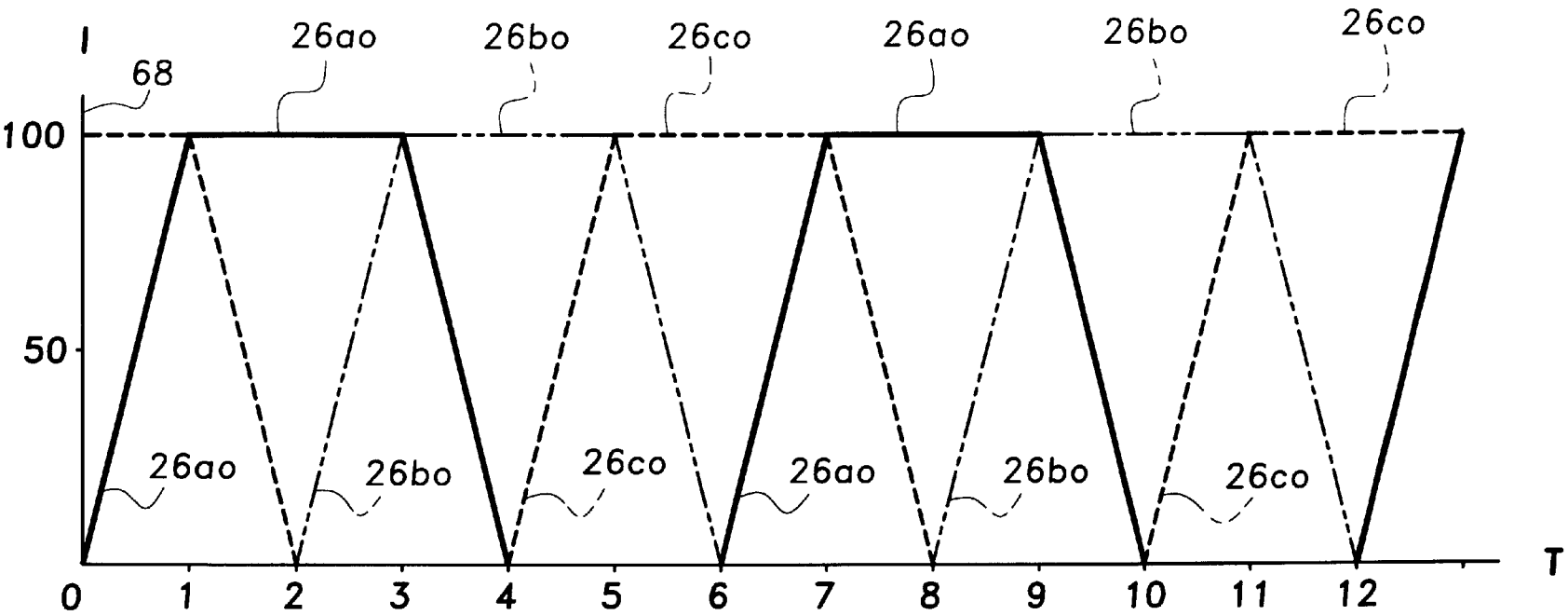
FIG. 5 is a graph showing the relative intensities of the various colors emitted by the LEDs of the present device, when electrical power thereto is varied according to a predetermined program.

FIG. 5 is a graph 64 of the relative output over time of the three LEDs 26*a* through 26*c*, in accordance with one possible operation with which the micro control unit 52 of FIG. 4 may be programmed. (It will be understood that the micro control unit 52 may be programmed to provide any one of a number of different programs for operating the LEDs 26 separately or collectively, as desired; the graph 64 of FIG. 5 illustrates the light output of the LEDs 26 in accordance with but one such possible program.) The horizontal axis 66 of the graph 64 represents time, with the units one through twelve shown along the horizontal axis representing units of time (e.g., four seconds each, but each number may represent an increase of time greater or less than four seconds, as desired according to the programming of the micro control unit 52). The vertical axis 68 represents the perceived intensity or output of the LEDs 26*a* through 26*c*, from zero to one hundred percent.

The heavy solid line of the graph 64 represents the output of the first LED 26*a*, and is designated as 26*ao*. The second line, comprising alternating single long and two short dashes, is designated as 26*bo*, and represents the output of LED 26*b*, while the evenly dashed third line 26*co* represents the output of the third LED 26*c*. Each of the LEDs 26*a* through 26*c* is cycled from zero to one hundred percent output and back to zero and to the beginning of the cycle over a period of twenty four seconds (represented by six time intervals, each comprising four seconds). As noted above, the micro control unit 52 may be programmed to provide other time intervals as desired.

It will be seen that the three LEDs 26*a* through 26*c* are driven sequentially according to the graph 64, with the output of the first LED 26*a* rising from zero to one hundred percent over the four second time interval between zero and one on the horizontal axis 66, and remaining at one hundred percent perceived output for eight seconds, i.e., from the interval between one and three along the axis 66, then dropping back to zero over a period of four seconds between time intervals three and four, and remaining at zero output for another eight seconds between time intervals four and six on the horizontal axis 66 of the graph 64. Thus, a complete cycle requires a total of six intervals, or twenty four seconds with such intervals lasting for four seconds each.

The output of the second LED 26*b* is programmed to follow a similar path, but begins its climb from zero to one hundred percent output at two intervals later (e.g., eight seconds, or one third of the cycle duration in the present example) than the first LED 26*a*. Finally, the third LED 26*c* is driven along a cycle essentially the same as that described for the first two LEDs 26*a* and 26*b*, but beginning at a point one third cycle later (two intervals, or eight seconds) than the beginning point for the cycle of the second LED 26*b*. The result is that as the third LED 26*c* reaches zero output, the output of the first LED 26*a* is just beginning to increase again. Thus, only a single one of the LEDs will be at zero power (or at one hundred percent perceived power) at any one point, with two of the LEDs simultaneously being at some partial brightness at all times during the program represented by the graph 64.

The above described operating program will result in the three LEDs 26*a* through 26*c* varying their collective color output over a complete cycle of six intervals, or twenty four seconds according to the example of the graph 64 of FIG. 5. If the first LED 26*a* produces a red light, the second LED 26*b* produces a yellow light, and the third LED 26*c* produces a blue light, then the colors will vary from an initial blue (at interval zero on the graph, where LEDs 26*a* and 26*b* are at zero output) through various perceived shades of blue-green and green as the intensity of the red LED 26*a* increases to reach the same maximum intensity as that of the blue LED 26*c* at interval one on the graph.

As the intensity of the third or blue LED 26*c* begins to decrease at interval one on the graph, the combined color output of the first (red) LED 26*a* and third (blue) LED 26*c* will gradually become a more yellowish green, with the color output being a pure red at interval two on the graph, where LEDs 26*c* and 26*b* are at zero output and LED 26*a* is at maximum output. At this point, the second (yellow) LED 26*b* begins to increase its output from zero to a maximum at interval three on the graph, thus producing colors ranging from red through orange to yellow as the red LED 26*a* reaches zero output at point four on the graph. The combined color output continues to shift at this point, as the third (blue) LED 26*c* begins to increase output, resulting in colors shifting between a pure yellow, through greenish-yellow and green, to a blue-green as the intensity of the blue LED 26*c* increases and the yellow LED 26*b* decreases to the sixth interval on the graph.

The above described cycle repeats over intervals six through twelve on the graph 64, and may be made to repeat endlessly as desired so long as electrical power is supplied to the circuit. The above described color pattern or program is but one of a virtually limitless number which may be provided by programming the micro control unit 52 as desired, with the programming essentially being conventional, in that it essentially varies the ground state of the three inputs (LEDs 26*a*, 26*b*, and 26*c*) over various predetermined time intervals as desired. While the above exemplary operation illustrated by the graph 64 of FIG. 5 is a sequential operation (with the intensity of two of the LEDs being varied simultaneously at various points in the program), it will be seen that the micro control unit 52 may be programmed to vary the intensity of all three of the LEDs 26*a* through 26*c* simultaneously to produce an even wider array of colors, if so desired.

The programming of the microcontroller 52 provides yet another benefit, by permitting the maximum intensity of any of the LEDs to be adjusted. Generally, blue color LEDs produce a lower perceived brightness than other colors of LEDs, even with the same amount of power being applied thereto. (Advances may permit more efficient blue LEDs to be used with the present invention.) Thus, in order to achieve the same perceived brightness from each of the LEDs, the red and yellow LEDs may be limited by providing higher resistances in their ground states, thus allowing less electrical power to flow therethrough. As the intensities are a perceived condition, the ground states (and intensities) may be adjusted as desired.

Figure 6:
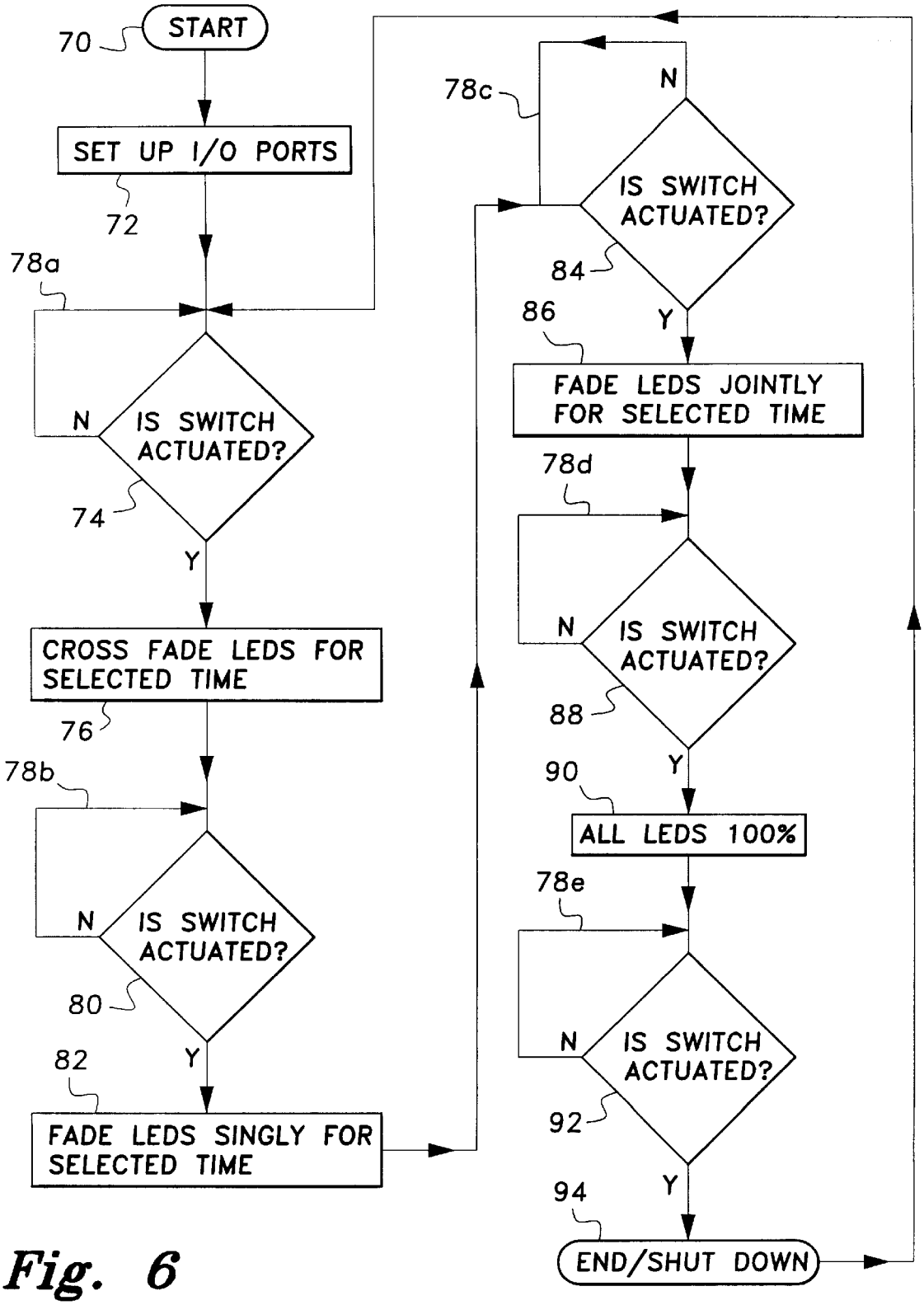
FIG. 6 is a flow chart showing the sequential operation of the present device according to the switch actuation and programming thereof.

As noted above, the present lighted display 10 with its programmable controller 52 permits virtually any color combination to be produced by the three differently colored LEDs 26*a* through 26*c*, and provides for the automated sequential or simultaneous activation of any or all of the LEDs 26. FIG. 6 provides a flow chart showing the general steps in the programming which might be used with the present invention. Basically, the micro control unit 52 is programmed to "count" sequentially the number of times the switch 56 has been momentarily closed, with each closure resulting in a different sequence of actuation for the three LEDs 26.

Beginning with the "Start" position 70 in the flow chart of FIG. 5, the controller 52 initializes the operation according to the "Setup" position 72 and signals the three LEDs 26 to produce no light, by providing an essentially infinite resistance to their ground states across the resistors 60*a* through 60*c* of the electrical schematic of FIG. 4. Thus, the system is essentially off at this point (with the exception of the internal operation of the micro control unit 52). The system next checks for switch actuation, as indicated by the next step 74 of FIG. 6. If the switch 56 is closed once, the micro control unit is programmed to "cross fade" the three LEDs 26*a* through 26*c* as indicated in the fourth step 76 of FIG. 6, i.e., raise and lower their intensities sequentially, as in the operation illustrated in the graph 64 of FIG. 5 and described above. This operation may be performed for a predetermined period of time, or may continue until the switch 56 is again momentarily closed.

In the event that no switch actuation has been detected by the micro control unit 52, the program is set up to "loop" back to continue to check for switch actuation, as indicated by the non-activation switch loop 78*a* of FIG. 6. Until the control unit 52 detects a subsequent switch actuation, it will continue to operate the most recently selected program for a predetermined period of time, or until another switch actuation is detected to signal it to switch to the next program in the sequence.

If a person wishes to activate some other preprogrammed operation of the present display device 10, other than the "cross fade" operation of the block 76 of FIG. 6, the switch 56 is momentarily closed for a second time. The micro control unit 52 detects this second switch actuation, as indicated by step 80, and is programmed to fade each of the LEDs 26*a* through 26*c* singly for some predetermined period of time (or until another operation is selected), as indicated by the second operation 82 of FIG. 6. The controller 52 continues to check for further switch operation, and if no further switch actuation is detected, loops back as indicated by the second loop 78*b* to continue the last selected operation.

This process continues, with a third switch actuation (step 84) causing the microcontroller 52 to switch to the next program in sequence, e.g., the "Fade LEDs jointly for selected time" step 86 of FIG. 6. The program then continues to check for further switch actuation, looping back via the loop 78*d* if no further switch actuation is detected.

A fourth switch actuation, indicated by the fourth actuation step 88 of FIG. 6, results in the micro control unit 52 switching to the next program in the system, e.g., turning all of the three LEDs 26*a* through 26*c* to one hundred percent of perceived intensity, as described generally in the fourth operational step 90 of FIG. 6. (Again, the actual ground resistance provided for each of the LEDs may vary in order to provide the desired equal perceived intensity or brightness to the human eye.) The microcontroller 52 continues to check for further switch operation by means of the loop 78*e*, and continues to run the program of the fourth step 90 until further switch actuation is detected.

If yet another switch actuation is detected, as indicated by the fifth switch actuation step 92 of FIG. 6, the control unit 52 is programmed to increase the resistance to each of the LEDs 26*a* through 26*c* to create essentially "open circuits," thus effectively shutting the system down, as indicated by the final step 94 of FIG. 6. Reactivation of the system is easily accomplished by actuating the switch 52 one more time, whereupon the system reinitiates with the "cross fade" operation 76 once again. It will be seen that the programming generally described herein may be varied and modified as desired, in order to provide still other effects than those described herein and shown in the flow chart of FIG. 6 of the present disclosure. For example, one of the LEDs could remain off, while the other two are cycled to produce a limited color array. Also, the exemplary program steps of FIG. 6 may be interchanged or modified as desired.

In summary, the present lighted display provides a most pleasing, relaxing, interesting, and entertaining means of displaying translucent articles, candles, statuary, etc. The variably colored lighting means provided by the present invention provides an ever changing appearance for articles displayed thereon, which continues to please and entertain viewers for much longer periods of time than a conventional work of art or other article viewed in conventional unchanging light. The present invention allows the lighting to be changed to fit the mood, the ambient lighting conditions, and/or the work of art or other article being displayed with the present display device, as desired.

As noted further above, the present display device is not limited to only those programs and operations exemplified in the present disclosure, but may be programmed to provide virtually limitless color combinations of the visual spectrum as desired. Thus, the present display device will find favor in innumerable public and private settings, from restaurants and similar establishments, art galleries and museums, private homes, and any environments where the beauty and interest provided by continually changing hues of light is appreciated.

It is to be understood that the present invention is not limited to the embodiments described above, but encompasses any and all embodiments within the scope of the following claims.

I claim:

1. A lighted display device for illuminating a translucent display article placed thereon, comprising:

a base for removable placement upon a level surface;

said base including an upper surface with a light passage formed therethrough, with said light passage having an upper end and an opposite lower end;

three light emitting diodes disposed beneath said upper surface of said base, and within said lower end of said light passage;

said diodes being positioned closely adjacent one another, and with each of said diodes emitting a primary color when appropriate electrical power is applied thereto; and a translucent article support removably installable atop said base, said article support being a flat sheet of material or a candle holder; and electrical circuitry for controlling said diodes;

whereby said diodes produce various colors of the visual spectrum and selectively illuminate a translucent display article.

2. The lighted display device according to claim 1, wherein said diodes each produce one of a subtractive primary color when illuminated.

3. The lighted display device according to claim 1, wherein said circuitry includes means for automatically incrementally varying the light intensity of each of said diodes sequentially as desired.

4. The lighted display device according to claim 1, wherein said circuitry includes means for automatically incrementally varying the light intensity of each of said diodes simultaneously as desired.

5. The lighted display device according to claim 1, wherein said base is formed of opaque materials.

6. The lighted display device according to claim 1, wherein said article support includes a light passage therethrough, generally concentric with said light passage of said base when said article support is removably installed on said base.

7. The lighted display device according to claim 1, including a generally toroidal receptacle disposed about said light passage of said base, for holding a liquid therein.

8. A lighted display device for illuminating a translucent display article placed thereon, comprising:

a base for removable placement upon a level surface;

said base including an upper surface with a light passage formed therethrough;

lighting means disposed beneath said upper surface of said base, and communicating with said light passage;

said lighting means emitting various colors of the visual spectrum when appropriate electrical power is applied thereto;

a translucent article support removably installable atop said base, said article support being a flat sheet of material or a candle holder; and electrical circuitry for controlling said lighting means;

whereby said lighting means produce the various colors of the visual spectrum and selectively illuminate a translucent display article.

9. The lighted display device according to claim 8, wherein said lighting means comprises three light emitting diodes each producing one of a subtractive primary color when illuminated.

10. The lighted display device according to claim 9, wherein said circuitry includes means for automatically incrementally varying the light intensity of each of said diodes sequentially as desired.

11. The lighted display device according to claim 9, wherein said circuitry includes means for automatically incrementally varying the light intensity of each of said diodes simultaneously as desired.

12. The lighted display device according to claim 8, wherein said base is formed of opaque materials.

13. The lighted display device according to claim 8, wherein said article support includes a light passage therethrough, generally concentric with said light passage of said base when said article support is removably installed on said base.

14. A lighted display device for illuminating a translucent display article placed thereon, comprising:

a base for removable placement upon a level surface;

said base including an upper surface with a light passage formed therethrough;

lighting means disposed beneath said upper surface of said base, and communicating with said light passage;

said lighting means emitting various colors of the visual spectrum when appropriate electrical power is applied thereto;

electrical circuitry for controlling said lighting means; and a generally toroidal receptacle disposed about said light passage of said base, for holding a liquid therein.

* * * * *